United States Patent [19]

Lloyd

[11] Patent Number: 4,814,099

[45] Date of Patent: Mar. 21, 1989

[54] INCORPORATING DETERGENT INTO A MELTBLOWN LAUNDRY DETERGENT SHEET VIA THE MELTBLOWING QUENCH SPRAY

[75] Inventor: William D. Lloyd, Neenah, Wis.

[73] Assignee: Kimberly-Clark Corporation, Neenah, Wis.

[21] Appl. No.: 189,858

[22] Filed: May 3, 1988

[51] Int. Cl.[4] ..... C11D 3/37; C11D 11/00; C11D 17/04; C11D 17/08

[52] U.S. Cl. ..... 252/91; 156/62.2; 156/167; 252/174; 252/DIG. 11; 427/242; 428/236; 428/245; 428/289

[58] Field of Search ..... 252/90, 91, 174; 428/236, 245, 260, 279, 289; 156/62.2, 167; 427/242

[56] References Cited

U.S. PATENT DOCUMENTS 4,100,324 7/1978 Anderson ..... 428/288
4,248,928 2/1981 Spadini ..... 428/286

*Primary Examiner*—Paul Lieberman
*Assistant Examiner*—Kathleen Markowski
*Attorney, Agent, or Firm*—Gregory E. Croft

[57] ABSTRACT

A method for making a meltblown liquid laundry detergent sheet provides increased active detergent solids by spraying a solution of detergent enchancers of the liquid detergent formulation into the meltblown web during the formation of the meltblown web. Thereafter the balance of the liquid detergent formulation is incorporated into the web, which is then dried.

4 Claims, 2 Drawing Sheets

INCORPORATING DETERGENT INTO A MELTBLOWN LAUNDRY DETERGENT SHEET VIA THE MELTBLOWING QUENCH SPRAY

BACKGROUND OF THE INVENTION

Laundry detergents are most commonly available in either liquid or powder form. In order to use such detergents, the user must measure out a certain quantity from a supply bottle or box and pour the measured amount into the clothes washer. In addition, if a fabric softener is desired, the fabric softener must be separately measured or at least separately deposited into the washer or dryer. Such multiple products, containers, and measuring can be messy and, at the very least an inconvenience, particularly for apartment dwellers who must carry all the necessary containers, etc., to the laundry area.

In this regard, the prior art discloses a variety of alternative cleaning products which are intended to provide improved convenience to the consumer. For example, U.S. Pat. No. 4,356,099 to Davies et al. discloses a laundry cleaning product comprising a plastic bag containing a liquid detergent. The bag has a weak seal which is opened by the mechanical action of the washing machine, thereby releasing the liquid detergent.

U.S. Pat. No. 4,188,304 to Clarke et al. discloses a similar detergent product comprising a plastic bag containing a particulate detergent. The bag contains a water-sensitive seal which discharges the contents of the bag when contacted with water.

U.S. Pat. No. 3,686,075 to Morton discloses a sheet substrate containing a fabric softener which is to be preferably used in the clothes dryer, but can also be added to a wash machine during its rinse cycle.

U.S. Pat. No. 4,170,565 to Flesher et al. discloses a laundry product comprising a detergent composition contained between two layers of a water-insoluble permeable substrate such as a polypropylene meltblown web. When contacted by water during the wash cycle, the detergent is dissolved and permeates through the substrate into the wash water. Most significantly, at column 1, lines 56–65, Flesher et al. apparently recognize the potential value of a single layer substrate for delivering laundry detergent, but concluded it is not feasible because of difficulty in loading the substrate with a sufficient amount of detergent and the sticky feel of any product that might be produced.

Therefore there is a need for a laundry cleaning product containing a sufficient premeasured amount of detergent which is convenient to use and economical to manufacture.

SUMMARY OF THE INVENTION

It has been discovered that meltblown webs possess a unique ability to absorb and hold an amount of liquid detergent sufficient to wash a load of laundry. However, it has also been found that in preparing liquid detergent formulations to be incorporated into the meltblown web, the presence of certain detergent enhancing ingredients, such as sodium citrate, creates an unstable solution and minimizes the total amount of surfactant that can be added to the detergent formulation. In turn, this limits the total amount of active detergent solids that can be incorporated into a meltblown detergent sheet. To overcome this difficulty, it has been discovered that the total amount of active detergent solids incorporated into the sheet can be increased if the sodium citrate and/or other detergent enhancers in the liquid detergent formulation are independently incorporated into the meltblown web prior to the balance of the formulation. In this way the creation of an unstable solution is avoided and the amount of active detergent solids that can be added to the total detergent formulation is increased by up to about 25 percent.

In general, the invention resides in a method for making a laundry detergent sheet comprising: (a) forming a meltblown web from molten thermoplastic meltblown fibers; (b) spraying the meltblown fibers with an aqueous solution of detergent enhancers, preferably before the meltblown fibers are formed into a web; (c) saturating the meltblown web with a solution containing the balance of the liquid detergent formulation; and (d) drying the web to a water content of about 10 percent or less. For purposes herein, "detergent enhancers" refers to liquid detergent formulation ingredients which promote phase separation of the detergent formulation and includes anti-redeposition agents, water softening agents, and salts.

The meltblown web can be any meltblown web made from a thermoplastic polymer having a melting point greater than 110° C. Polymers which melt at lower temperatures are more likely to melt if exposed to clothes dryer temperatures. A suitable polymer is polypropylene, which is the most commonly used polymer for making meltblown webs. However, polymers having melting points of about 165° C. or greater, and preferably about 200° C. or greater are preferred. Preferred polymers include poly(ethylene terephthalate), which melts at about 250° C., polycaprolactam (nylon 6), which melts at about 220° C., poly(butylene terephthalate), which melts at about 221° C., and polymethyl pentene, which melts at 240° C.

The process for making meltblown webs is well known in the art and is used extensively for manufacturing a wide variety of commercial nonwoven products. Representative examples of the meltblowing process are described in U.S. Pat. No. 3,978,185 to Buntin et al. dated Aug. 31, 1976; U.S. Pat. No. 4,298,649 to Meitner dated Nov. 3, 1981; and U.S. Pat. No. 4,100,324 to Anderson et al. dated July 11, 1978, all herein incorporated by reference. For purposes of meltblowing, it is preferred that the apparent viscosity of the polymer as it leaves the die tip be about 500 poise or less, most preferably from about 150 to about 300 poise. Higher apparent viscosities provide lower throughputs which are generally unsatisfactory for commercial operation. Increased throughputs can be achieved by lowering the apparent viscosity, which can be lowered either by lowering the molecular weight of the polymer or by raising the temperature of the polymer. It will be appreciated, however, that other meltblowing processes will produce webs suitable for purposes of this invention. The meltblown web can be combined or laminated to other supporting webs, such as spunbonded webs, in order to impart strength or other attributes to the product.

The basis weight for a single sheet of the untreated meltblown base webs of this invention can range from about 80 to about 300 grams per square meter. Preferably the basis weight will be from about 110 to about 250, and most preferably about 160 grams per square meter. Basis weights lower than the abovesaid range lack sufficient pore volume to hold the amount of liquid detergent necessary to wash a load of laundry at a reasonable sheet size. Basis weights greater than the abovesaid range are too difficult to convert. It is within the scope of this invention, however, to incorporate more than one ply into the product to increase the detergent load.

The size of the meltblown web can be from about 200 to about 2000 square centimeters, preferably from about 600 to about 1,000 square centimeters, and most preferably about 800 square centimeters. The minimum size of the web is limited by the amount of liquid detergent the web can absorb and hold. The maximum size is determined by consumer acceptance, convenience and packaging considerations. It is preferred that the meltblown web be pattern bonded to maintain integrity during use. Pattern bonding is commonly performed during manufacture of meltblown webs by hot embossing or ultrasonic bonding of the newly formed web.

The liquid detergent formulations useful for making products in accordance with this invention can be any liquid detergent which is suitable for cleaning laundry. As is well known in the detergent arts, these formulations typically contain a large number of components such as surfactants, fragrances, brighteners, dyes, solubilizers, pH adjusters, and detergent enhancers.

Specific detergent enhancers which can be added to the meltblown web in accordance with this invention include sodium citrate, carboxymethyl cellulose, EDTA salts, sodium carbonate, sodium silicate, phosphates, alumino silicates, nitrilotriacetic acid salts, sodium borate, poly(vinyl alcohol), poly(vinyl acetate), and polyvinyl pyrrolidone. The amount of each of the foregoing ingredients will vary widely depending upon the specific detergent formulation. However, in general, the detergent enhancers can be present in the following amounts (grams per sheet): water softeners (0–20); and anti-redeposition agents (0–5). Other ingredients which can also be included are: pH control agents (0–10); enzymes (0–5); and brighteners (0–3).

The detergent ingredients which can be incorporated into the meltblown web after the detergent enhancers have been added primarily include the active detergent solids, such as surfactants such as nonionic, anionic, amphoteric, and cationic surfactants. Other phase-compatible ingredients can also be included with the active detergent solids, such as stabilizers, pH control agents, brighteners, enzymes, dyes, etc.

DETAILED DESCRIPTION OF THE DRAWING

Figure 1:
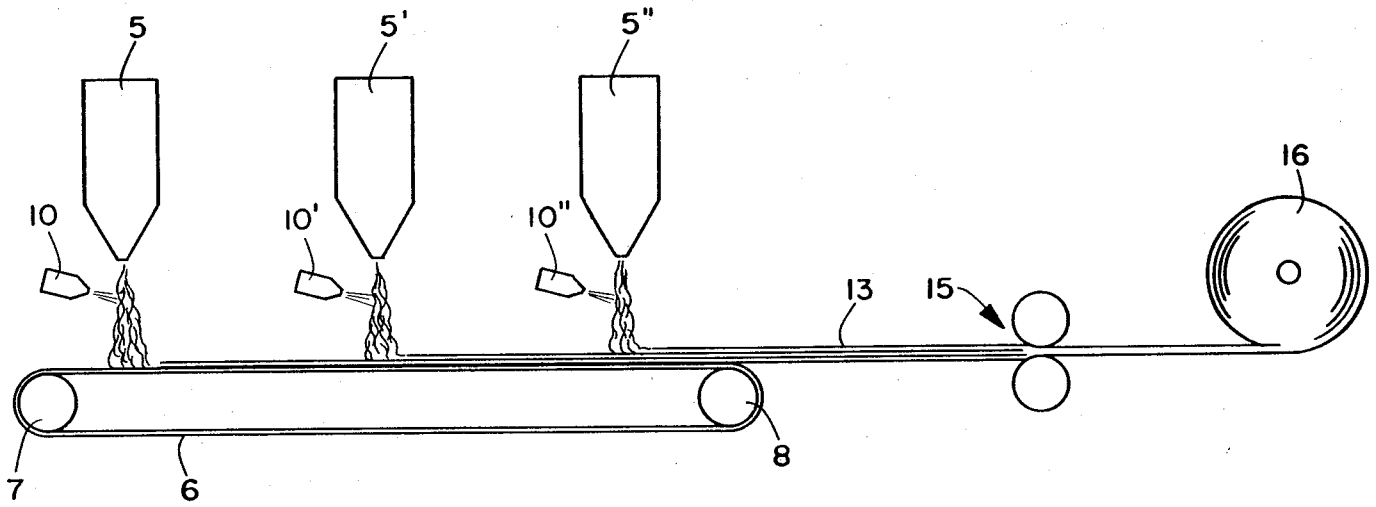
FIG. 1 is a schematic view of a meltblowing process for incorporating the detergent enhancers into the meltblown web in accordance with this invention.

Directing attention to FIG. 1, the invention will be described in greater detail. Shown is a process for making meltblown webs utilizing a plurality of meltblowing die tips 5. These die tips are variously referred to as "heads" or "banks." The die tips substantially extend across the width of the forming fabric 6, which travels in a continuous loop around rolls 7 and 8, at least one of which is suitably driven. Each of the die tips is supplied with molten polymer from an extruder and a source of compressed air. The extrudate is broken up by the compressed air to form discontinuous molten fibers which are deposited onto the traveling forming wire to form the web. Shown in FIG. 1 for purposes of illustration are three die tips in series, but for purposes of this invention any number can be used depending upon the throughput from each die tip, desired production speeds, and the basis weight of the meltblown web product. Each die tip can be accompanied by an aqueous quench shower or spray 10 as shown which serves to set the molten polymer fibers into a nonwoven fibrous network. The quench shower is generally directed at the extruded fibers between the extrusion die and the forming fabric. It can, however, also be directed at the newly-formed web between banks. After formation, the resulting meltblown web 13 is preferably passed through a hot embossing roll nip 15 to thermally bond the web and enhance its integrity. The web is then wound up on a suitable roll 16 for further processing or converting.

In accordance with this invention, one or more of the quench sprays comprise an aqueous solution or dispersion of detergent enhancers and/or other detergent formulation ingredients as previously described. The concentration of each ingredient will vary with the specific detergent formulation, the particular ingredient, the number of quench sprays, the line speed, the basis weight of the meltblown web, etc.

It is preferred that the detergent formulation ingredients be incorporated into the meltblown web only via quench sprays accompanying the intermediate die tips and not via the first and/or last die tip(s). The reason for this preference is that some of the detergent ingredients can cause stickiness, which is better confined to the central portion of the meltblown web rather than being present on the surface(s). Therefore, referring to FIG. 1, the preferred detergent ingredient-containing quench would be quench spray 10'. However, for purposes of this invention, all quench sprays can contain one or more detergent ingredients.

Figure 2:
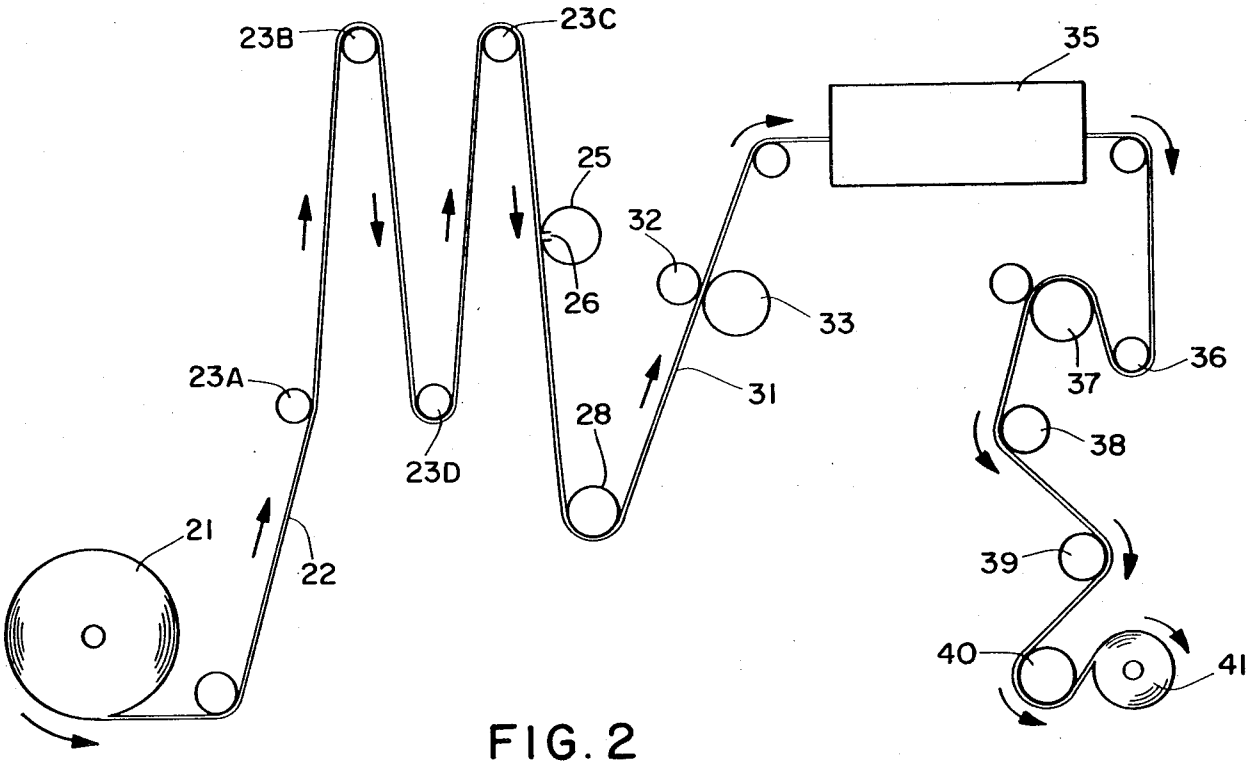
FIG. 2 is a schematic view of a method for saturating the meltblown web with the balance of the liquid detergent formulation.

FIG. 2, shows a supply roll 21 of the meltblown web material, which contains certain detergent ingredients as described in connection with FIG. 1, to be saturated with the balance of the liquid detergent formulation. Preferably the web has been thermally pattern-bonded to provide sufficient integrity to withstand a wash and dry cycle without disintegrating. The web 22 is passed through a series of tension control rolls 23A, 23B, 23C, and 23D and passed over a slotted bar applicator 25 which is filled with an aqueous solution containing the balance of the detergent formulation, primarily containing the active detergent solids. As used herein, a "slotted bar" applicator includes applicators having slots, holes, or other orifices which serve to deposit the solution onto the surface of the web, such as by coating, injecting, printing, and the like. The solution is deposited onto the web through a slot 26 to saturate the web with the solution. The rate at which the solution is applied to the web will depend upon the line speed, the detergent composition, the absorbency of the web, etc. Other means for incorporating the solution into the web are also suitable, however. The solution can be applied to either or both sides of the web.

After leaving the slotted bar applicator, the saturated web 31 passes through a controlled nip between nip rolls 32 and 33 which serves to enhance the even distribution of the solution throughout the web.

The treated web then passes through a dryer 35, preferably an air flotation dryer, which removes substantially all (up to about 95 percent) of the available moisture, which includes alcohol and water. More typically the moisture removal will be on the order of about 80 percent. The product leaving the dryer contains concentrated liquid detergent having a gel-like consistency, yet the web has an acceptable feel.

After drying, the dried web passes around a tension control roll 36, a pull roll 37, a slitter roll 38, a Mount Hope roll 39, and a rewind drive roll 40. The web is thereby wound onto the rewind roll 41 for subsequent converting and packaging operations.

It will be appreciated that the foregoing discussion, given for purposes of illustration, is not to be construed as limiting the scope of this invention.

I claim:

1. A method for making a laundry detergent sheet comprising:

(a) forming a meltblown web from molten thermoplastic meltblown fibers wherein said meltblown web is formed with a plurality of meltblown blanks;

(b) spraying the meltblown fibers with an aqueous solution of detergent enhancers of a liquid detergent formulation wherein the meltblown web is sprayed with the aqueous solution at least once prior to the last meltblown bank;

(c) saturating the meltblown web with a solution containing the balance of the liquid detergent formulation ingredients; and (d) drying the web to a water content of about 10 percent or less.

2. The method of claim 1 wherein the aqueous solution is sprayed into the meltblown fibers before the fibers are formed into a web.

3. The method of claim 1 wherein the aqueous solution is sprayed onto an intermediate web.

4. The method of claim 1 wherein the aqueous solution contains at least one detergent enhancer selected from the group consisting of sodium citrate, salts of ethylenediaminetetraacetic acid, and carboxymethyl cellulose.

* * * * *